US007163084B1

(12) United States Patent
Blehm

(10) Patent No.: US 7,163,084 B1
(45) Date of Patent: Jan. 16, 2007

(54) ADJUSTABLE LADDER STABILIZER

(76) Inventor: Berle G. Blehm, 3120 Foothill Blvd., Oroville, CA (US) 95966

( * ) Notice: Subject to any disclaimer, the term of this patent is extended or adjusted under 35 U.S.C. 154(b) by 0 days.

(21) Appl. No.: 11/147,012

(22) Filed: Jun. 7, 2005

(51) Int. Cl.
*E06C 7/00* (2006.01)

(52) U.S. Cl. ..... 182/172; 182/204

(58) Field of Classification Search ..... 182/172, 182/107, 108, 204
See application file for complete search history.

(56) References Cited

U.S. PATENT DOCUMENTS 3,508,628 A * 4/1970 Conrad ..... 182/172
4,175,641 A * 11/1979 Reyes ..... 182/172
5,511,632 A * 4/1996 Ermis ..... 182/172
5,590,739 A * 1/1997 High et al. ..... 182/169
5,868,222 A * 2/1999 Charbonneau ..... 182/172
6,533,071 B1 * 3/2003 Smith ..... 182/172
6,672,427 B1 * 1/2004 Sheffield ..... 182/172
2005/0077106 A1 * 4/2005 Grundler ..... 182/97

* cited by examiner

*Primary Examiner*—Alvin Chin-Shue
(74) *Attorney, Agent, or Firm*—William W. Bodnar

(57) ABSTRACT

An adjustable ladder stabilizer assembly composed of sturdy, lightweight components that can be temporarily or permanently affixed to the side rails of a ladder and adjusted to a variety of positions to provide lateral support. This stabilizer assembly can also be folded up and easily secured in a storage position to fit within the profile of a ladder when not in use.

7 Claims, 4 Drawing Sheets

ADJUSTABLE LADDER STABILIZER

CROSS REFERENCE TO RELATED APPLICATIONS

None.

FIELD OF INVENTION

This present invention relates in general to ladder support assemblies and in particular to assemblies attached to the sides of ladders to provide lateral support.

BACKGROUND OF INVENTION

Ladders, especially extension ladders, are very effective in allowing a person to reach a high, otherwise inaccessible position for painting, repair or other related tasks. Extension ladders are commonly used by workers in performance of their occupation as well as homeowners making repairs on their property. Ladders usually have a pair of leg members spaced apart by and connected to a series of parallel rungs. When properly placed on flat, stable ground, the ladder is usually relatively stable longitudinally, namely in the vertical plane that bisects the rungs.

However, accidents frequently occur because of lateral tipping or slipping movements. If the ladder is not completely vertical the chances of it tipping laterally as the person rises thereon increases as the height above the ground increases. Accidents caused by such lateral movement of the ladder are particularly likely when the climber is at the top of the ladder. It is therefore very desirable to provide a simple, safe, effective means for providing lateral stability to a ladder for use under otherwise unsafe conditions.

Many people have attempted to provide ladder supports in the past. Each attempt has involved relatively complex structures to be added to the ladder. Most devices are not easily attached to the ladder and once attached, add significant weight to the ladder. One such device is the device described in U.S. Pat. No. 4,244,446 which utilizes a long channel member that is attached to one or both sides of the ladder rails. These channel members alone add prohibitive weight to the ladder. The support members attached to the channel members (and the ladder) add additional weight.

One other disadvantage of the elongated channel member of U.S. Pat. No. 4,244,446 is the channel can be a collector of dust or dirt or soil making the adjustment of such a device cumbersome. Extension ladders are most frequently utilized (and often stored) outdoors and subject to accumulating dirt on the rails. The channel design of U.S. Pat. No. 4,244,446 provides a repository for dirt and debris that could adversely affect the usefulness of such a support device particularly regarding adjustment.

In U.S. Pat. No. 4,655,322 a clamp for a safety leg of a ladder is described. While this device does not have the complexity of previous ladder support devices, it utilizes a clamp to attach the support device to the outside edges of the ladder rails. This presents a major problem to the user. Often persons climbing up or down a ladder will hold onto the ladder on the rails and essentially let their hand slide along the rail. The clamping device of U.S. Pat. No. 4,655,322 will prohibit persons from safely sliding their hand along the rail because of the protrusions of the clamp.

The present invention provides a lightweight device that can be attached to either side of an extension ladder to provide a user with lateral support. It addresses and overcomes the problematic issues of prohibitive weight and complexity presented by previous attempts to address this issue.

It is an object of the present invention to provide a ladder attachment assembly which will provide lateral support and stability. It is also an object of the present invention to provide a lightweight ladder attachment assembly that will not encumber reasonable use of a ladder.

A further object is to provide a ladder attachment assembly that can be easily positioned to adjust to uneven terrain for maximum lateral support. In addition, a user may also easily position the assembly in an upright position within the profile of the ladder for temporary, semi-permanent or permanent storage.

Yet another object is to allow a user to easily affix the ladder attachment assembly to the ladder. A major advantage is also achieved by the modular components which allow the bracket of the assembly to remain attached to the ladder while easily removing the remaining assembly components. This allows the user to reduce the weight of the ladder while the assembly is not in use without having to detach the entire assembly.

SUMMARY OF INVENTION

The adjustable ladder stabilizer provides a ladder support assembly that is relatively easy to produce, easy to install, easy to use, and above all, safe. This stabilizer can be quickly and easily adjusted to provide support on a variety of level or uneven surfaces including floors, patios, ground, pavement, etc.

BRIEF DESCRIPTION OF DRAWINGS

The character of an embodiment of the invention, however, may be best understood by reference to one of its structural forms, as illustrated by the accompanying drawings, in which.

DETAILED DESCRIPTION (OF A PREFERRED EMBODIMENT)

Figure 1:
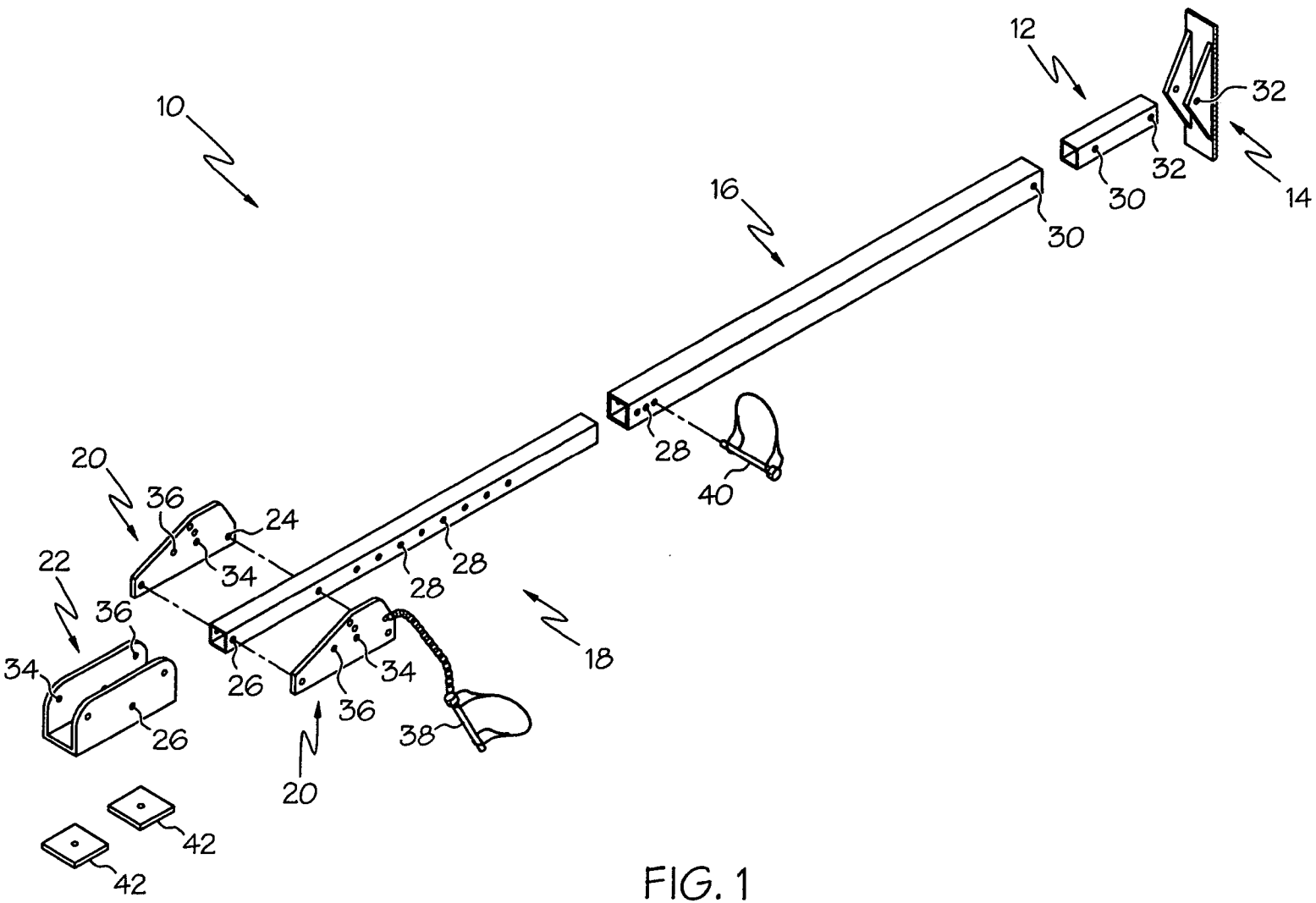
FIG. 1 is an exploded view of the individual components of the ladder stabilizer assembly.

Referring to FIG. 1, which best shows the general features of a preferred embodiment of the invention, the lower support member 12 is attached to a base member 14 at one end and the support housing 16 at an opposite end. The attachment means are typically bolts (not shown) but any suitable attachment means will suffice. The support housing 16 is connected to the upper support member 18 via a locking pin 40 inserted through adjusting/affixing apertures 28.

Indexing plates 20 are secured to the upper end of the upper support member 18 typically by bolts (not shown) inserted through apertures 24. The upper support member 18 and index plates 20 are pivotally secured in channel bracket 22 by a bolt (not shown) through pivot apertures 26. The channel bracket 22 can best be described as a U-shaped bracket with a base section and two leg sections forming the U shape.

Figure 2:
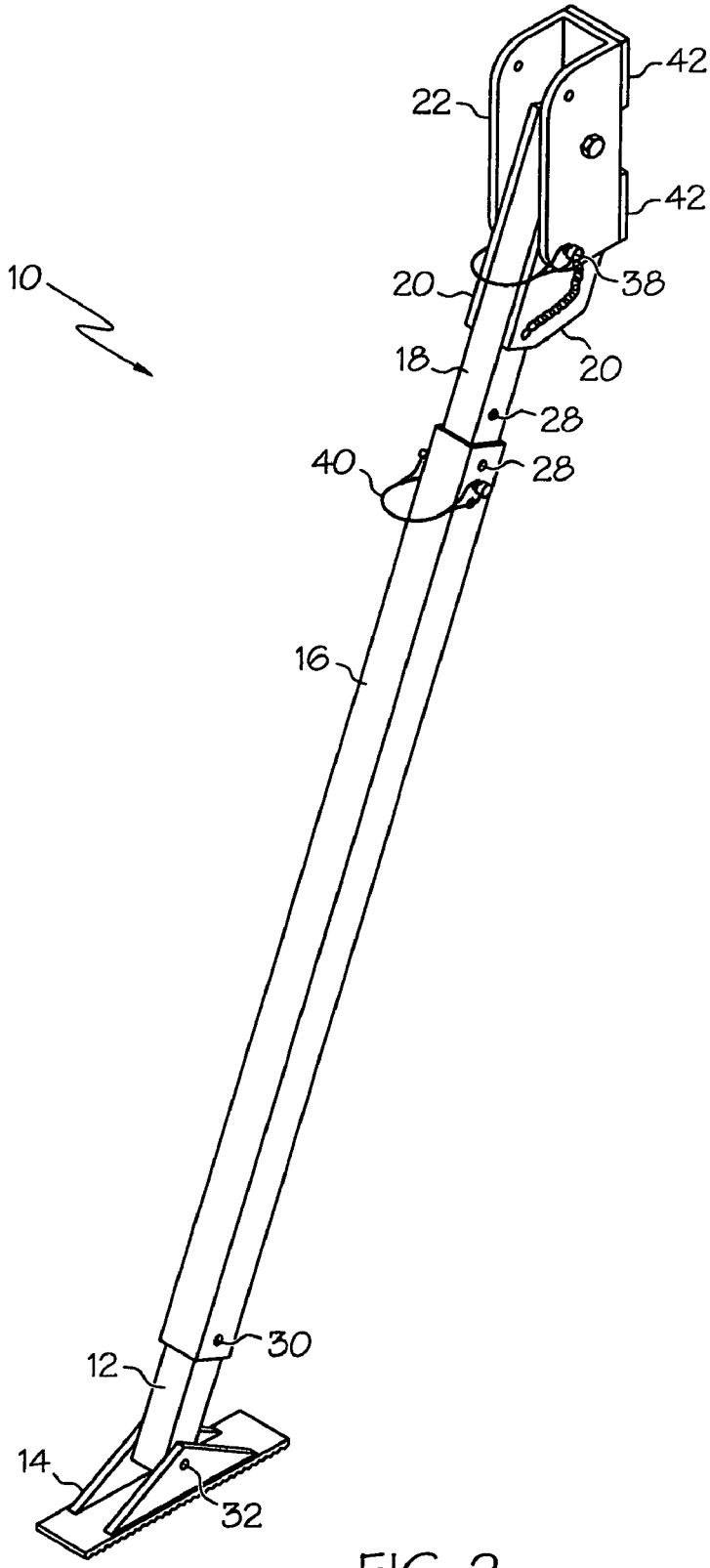
FIG. 2 is a perspective view of an unattached ladder stabilizer assembly fixed in support position.

FIG. 2 is a perspective view of unattached ladder stabilizer 10 in support position. Quick release wire lock pin 40 is shown securing upper support member 18 to support housing 16. Quick release wire lock pin 38 is used to secure index plates 20 and the rest of the assembly at the proper angle to channel mounting bracket 22.

Figure 3:
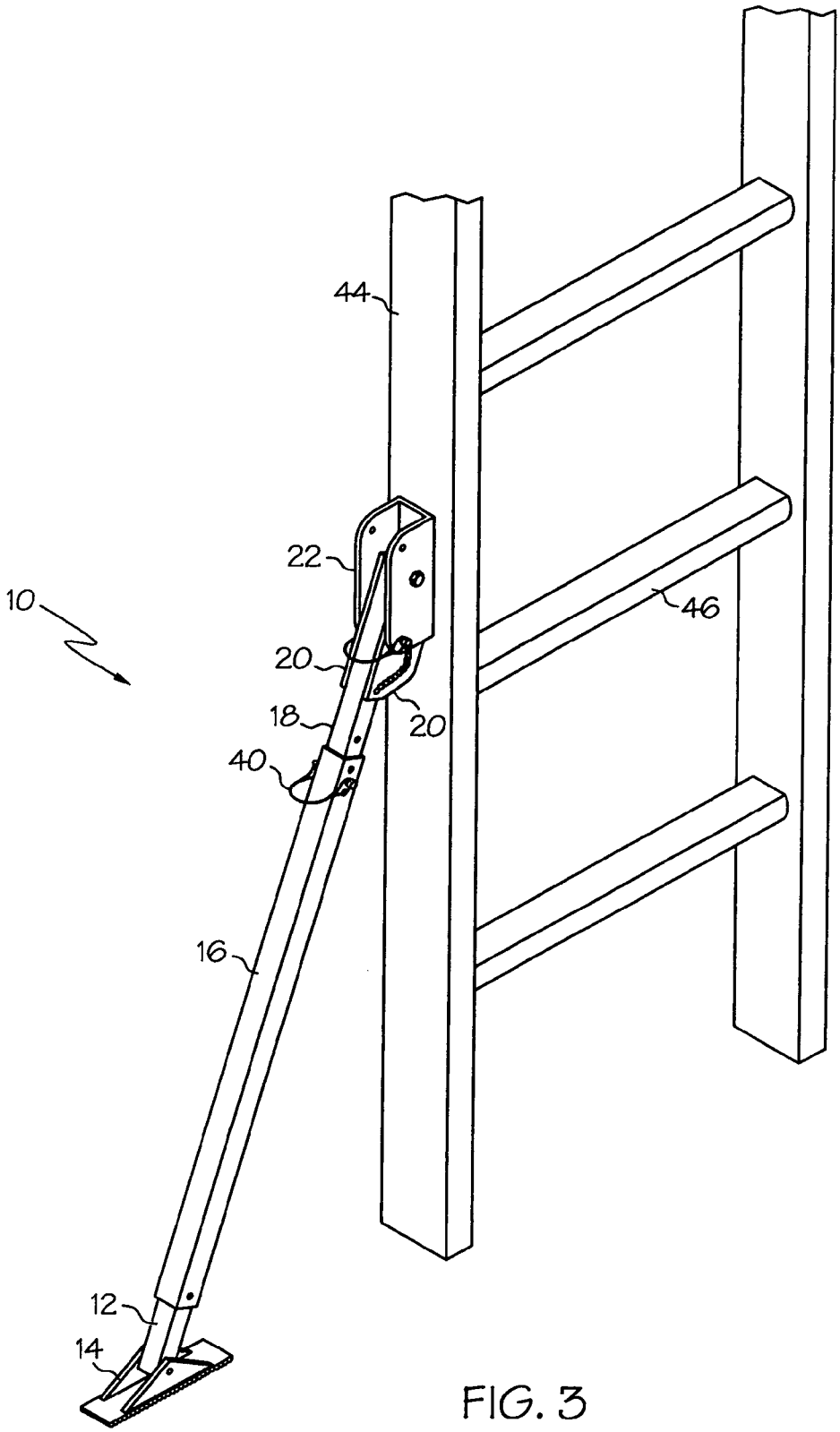
FIG. 3 is a perspective view of an adjustable ladder stabilizer assembly attached to a ladder and fixed in support position.

FIG. 3 is a perspective view showing the ladder stabilizer 10 secured to a ladder 44 and locked in support position. Note that the channel mounting bracket 22 is affixed to the ladder rail 44 between two of the rungs 46 of the ladder.

Figure 4:
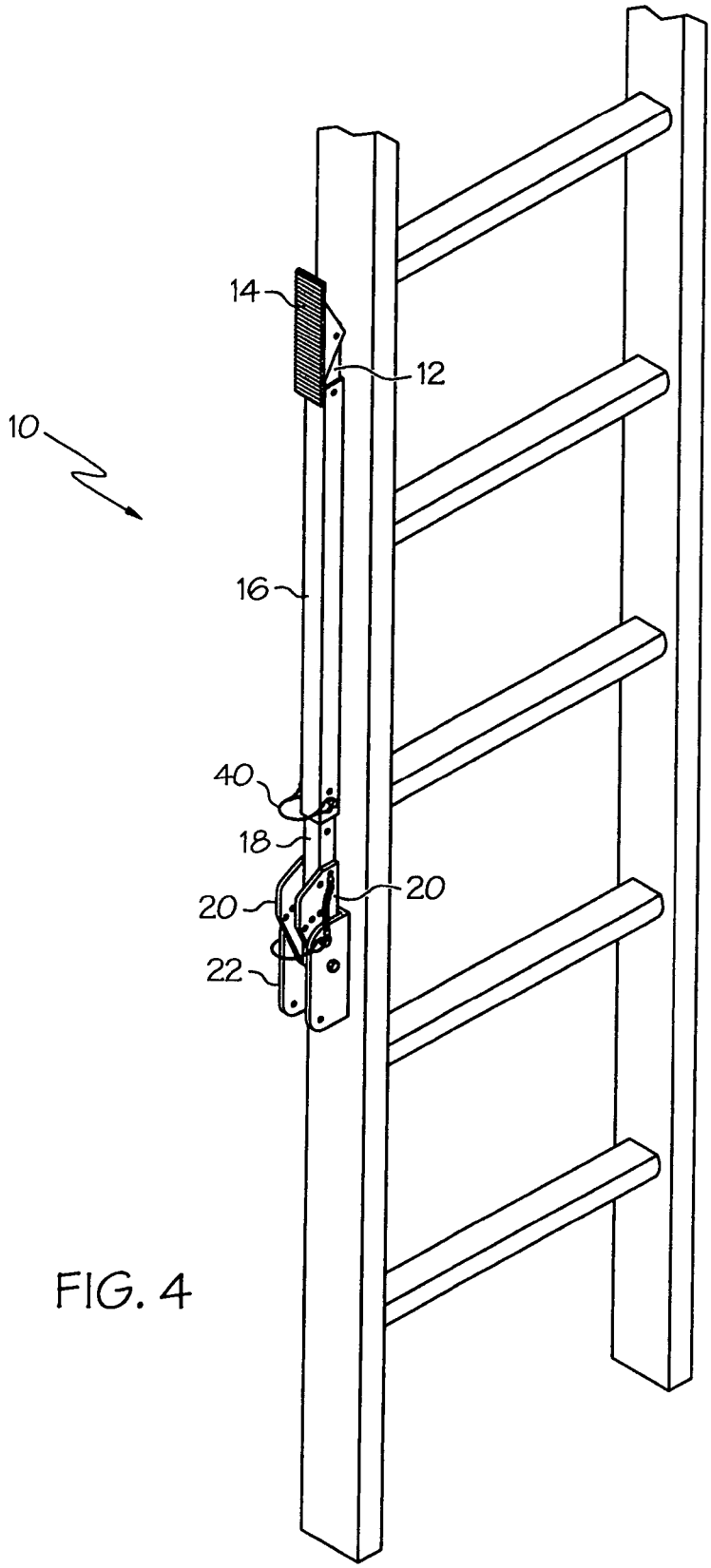
FIG. 4 is a perspective view of an adjustable ladder stabilizer assembly attached to a ladder and fixed in storage position.

FIG. 4 is a perspective view showing the ladder stabilizer 10 secured to a ladder 44 and locked in storage position.

CONCLUSIONS, OTHER EMBODIMENTS, AND SCOPE OF INVENTION

The ladder stabilizer structural components are typically manufactured utilizing metal (aluminum or steel) but easily composite, polymer, epoxy resins or any other suitable metal substitute can be used for most structural components. The strength and durability of non-metal composites rivals that of metal counterparts in many cases. Non-metal components offer the advantage of decreased weight which would allow a user to more easily transport and position a ladder with a stabilizer assembly attached. Other embodiments could include a combination of metal and non-metal components.

The adjustable ladder stabilizer is attached to the side rails of a ladder by drilling holes in the rails and attaching the channel mounting bracket 22 to the ladder by any suitable attachment means but typically with bolts. As illustrated in FIG. 3, the channel mounting bracket 22 can be positioned on the rail between two adjacent rungs 46 of the ladder. A bracket thus positioned would not necessarily need to utilize the spacers 42. However the spacers could be used on the outer or inner surface of the rail for added support.

In some cases, the channel mounting bracket 22 must be positioned against the ladder rail directly over the end of a ladder rung 46. On some ladders, typically aluminum, the end of the ladder rung 46 creates a protruding surface on the outside of the rail where it is attached. In these circumstances where the channel mounting bracket is placed over the rung, the two spacers 42 can be utilized above and below the rung protrusion to provide two flat surfaces for the channel mounting bracket to be mounted against. Typically fiberglass ladders do not have a protruding surface on the outside the rail where the rung is attached. The spacers 42 can also be positioned on the inside of the ladder rails or not utilized if desired.

The remaining components of the ladder stabilizer assembly are attached to the channel mounting bracket 22 and hence the ladder via a bolt through apertures 26. The channel mounting bracket can be affixed to one or both sides of the ladder and left on the ladder permanently if desired without adding undesirable weight to the ladder. The remaining components can be easily attached when needed by attaching one bolt.

Adjusting the angle of the ladder stabilizer in support position as illustrated in FIG. 3 is easily accomplished by utilizing a locking pin through one of the apertures on the index plates. The index plates can be referred to as an indexing mechanism and the locking pin as a positioning device. The desired aperture on the index plate is aligned with the corresponding apertures on the channel bracket and the locking pin is inserted and fastened. The length of the assembly is easily adjusted by sliding upper support member 18 through support housing 16 and securing their positions via another locking pin 40 through apertures 28. The upper support member, support housing, lower support member and base can be collectively referred to as a telescoping support assembly.

It should be noted that any suitable base member can be used to provide contact with the support surface the stabilizer assembly rests upon. Typically base members will have a friction surface to prevent slippage. The friction surface can be comprised of any material that substantially increases the friction between the base member and the support surface. Suitable materials include, but are not limited to, rubber, including vulcanized rubber, and semi-rigid thermoplastic and such material may include ridges and dimples on its lower surface as an aid to friction. The friction surface may be replaceable and interchangeable so that a variety of friction surfaces may be used as appropriate for variation of the ground type that the ladder stabilizer may be required to rest upon.

Modifications of the base member may include any suitable device commonly known by one skilled in the art. Variations may include friction surfaces of uneven thickness to accommodate the angle that is defined by the ladder resting against a support surface, or pivot/swivel options to provide adjustability to the whole base member as a unit.

While the preferred embodiment of the present invention includes one support housing 16 and one lower support member 12, another embodiment could include an additional support housing and additional lower support member. These additional components would be inserted between the lower support member 12 and the base member 14 shown in FIG. 1. These additional components would allow the adjustable ladder stabilizer to have a greater overall length and provide support when positioned higher up on the ladder. This embodiment could also be useful if the support surface the ladder stabilizer rests upon slopes away from and/or is lower than the base of the ladder.

Although the present invention is directed to extension ladders it could also be effectively utilized with non-extension ladders.

From the foregoing, the construction and utility of the adjustable ladder stabilizer assembly should be readily understood. However, because numerous changes and modifications may readily occur to those skilled in the art, it is not desired to limit the invention to the exact constructions shown and described, and accordingly, all suitable modification and equivalents may be resorted to, falling within the scope of the appended claims.

What is claimed is:

1. An adjustable ladder stabilizer assembly for providing lateral support for a ladder comprising:

a u-shaped channel bracket connected to a ladder;

an indexing mechanism pivotally connected to said u-shaped channel bracket;

a telescoping support assembly connected to said indexing mechanism and pivotally connected to said u-shaped channel bracket;

a positioning device securing said indexing mechanism and said telescoping support assembly at a plurality of positions relative to and confined within said u-shaped channel bracket; wherein said U-shaped channel bracket comprises a bracket base section and two parallel leg sections; and said two parallel leg sections comprises a plurality of aperture to accommodate pivotal attachment to said index mechanism and said telescoping support assembly, said indexing mechanism comprises two index plates secured to said telescoping support assembly in a position parallel to and opposite each other and separated by said telescoping support assembly, said positioning device comprises aligned apertures in said parallel leg sections, a plurality of index apertures in each index plate and a quick release fastener inserted in through said aligned apertures and selected ones of said index apertures to lock said telescoping support assembly in selected positions relative to said U-shaped channel bracket.

2. The adjustable ladder stabilizer assembly of claim 1 wherein said telescoping support assembly further comprises:

a base member;

a lower support member connected to said base member;

a support housing connected to said lower support member;

an upper support member connected at one end to said support housing and at an opposite end to said u-shaped channel bracket and said index plates.

3. The adjustable ladder stabilizer assembly of claim 1 wherein the telescoping support assembly base member further comprises a surface capable of providing contact with the ground, floor or any suitable support surface.

4. The adjustable ladder stabilizer assembly of claim 3 wherein:

said lower support member further comprises a plurality of apertures for attachment at one end to said lower support base member and at the opposite end to a support housing;

said support housing further comprises a plurality of apertures for attachment at one end to said lower support member and at the opposite end to an upper support member;

said upper support member further comprises a plurality of apertures for attachment at one end to said support housing and at the opposite end to said two index plates and said U-shaped channel bracket.

5. The ladder stabilizer assembly of claim 2 wherein said upper support member is connected at one end to said support housing by a quick release locking mechanism.

6. The ladder stabilizer assembly of claim 2 wherein said base member adjusts to the contour of the ground, floor or support surface.

7. The ladder stabilizer assembly of claim 1 further comprising spacers to allow said u-shaped channel bracket to be secured to the rails of a ladder directly over the end of the ladder rungs.

* * * * *